US011069292B1

(12) United States Patent
Heganovic et al.

(10) Patent No.: US 11,069,292 B1
(45) Date of Patent: Jul. 20, 2021

(54) TFT PIXEL THRESHOLD VOLTAGE COMPENSATION CIRCUIT USING A VARIABLE CAPACITOR

(71) Applicant: Sharp Kabushiki Kaisha, Osaka (JP)

(72) Inventors: Adnan Heganovic, Oxford (GB); Tong Lu, Oxford (GB); Michael James Brownlow, Oxford (GB)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 16/856,447

(22) Filed: Apr. 23, 2020

(51) Int. Cl.
*G09G 3/325* (2016.01)
*G09G 3/3283* (2016.01)

(52) U.S. Cl.
CPC ..... *G09G 3/325* (2013.01); *G09G 3/3283* (2013.01); *G09G 2320/0204* (2013.01)

(58) Field of Classification Search
CPC ..... G09G 3/325; G09G 3/3283; G09G 2320/0204
See application file for complete search history.

(56) References Cited

U.S. PATENT DOCUMENTS 10,192,481 B2 1/2019 Cho et al.
2010/0053141 A1* 3/2010 Ishiguro ..... G09G 3/3233 345/211
2019/0147799 A1* 5/2019 Kim ..... G09G 3/3233 345/55

* cited by examiner

*Primary Examiner* — Vijay Shankar
*Assistant Examiner* — Kebede T Teshome
(74) *Attorney, Agent, or Firm* — Renner, Otto, Boisselle & Sklar, LLP

(57) ABSTRACT

A pixel circuit for driving a light-emitting device for a display device is operable in an initialization phase, a compensation phase, a data programming phase, and an emission phase. The one horizontal time is minimized while maintaining accurate compensation of the threshold voltage of the drive transistor, and the pixel circuit further employs a varactor to compensate for variations in the threshold voltage of the drive transistor and for parasitic capacitances that arise within the pixel circuit. A capacitance of the varactor varies with a voltage at a node N1 constituting an electrical connection during the compensation phase of the drive transistor, the light-emitting device, a storage capacitor, and the varactor. The use of the capacitance variation of the varactor accounts for a variation in the threshold voltage of the drive transistor and for parasitic capacitances in the pixel circuit. The varactor may be implemented as a thin film transistor that operates as a variable capacitor.

20 Claims, 9 Drawing Sheets

- 0 → Emission
- 1 → Initialization
- 2 → Compensation
- 3 → Programming (1H)
- 4 → Emission

- 0 → Emission
- 1 → Initialization
- 2 → Compensation
- 3 → Programming (1H)
- 4 → Reset Anode of OLED
- 5 → Emission

- 1 → Initialization
- 2 → Compensation
- 3 → Programming (1H)
- 4 → Emission

- 1 → Initialization
- 2 → Compensation
- 3 → Programming (1H)
- 4 → Reset Anode
- 5 → Emission Where:

- $C_{OL_T3}$ is the overlap capacitance of T3
- $C_{OL_T2}$ is the overlap capacitance of T2
- $C_{GD}$ is the gate drain capacitance of TD $$C_{par} = C_{OL_T2} + C_{OL_T3} + C_{GD}$$

TFT PIXEL THRESHOLD VOLTAGE COMPENSATION CIRCUIT USING A VARIABLE CAPACITOR

TECHNICAL FIELD

The present invention relates to design and operation of electronic circuits for delivering electrical current to an element in a display device, such as for example to an organic light-emitting diode (OLED) in the pixel of an active matrix OLED (AMOLED) display device.

BACKGROUND ART

Organic light-emitting diodes (OLED) generate light by re-combination of electrons and holes, and emit light when a bias is applied between the anode and cathode such that an electrical current passes between them. The brightness of the light is related to the amount of the current. If there is no current, there will be no light emission, so OLED technology is a type of technology capable of absolute blacks and achieving almost "infinite" contrast ratio between pixels when used in display applications.

Several approaches are taught in the prior art for pixel thin film transistor (TFT) circuits to deliver current to an element of a display device, such as for example an organic light-emitting diode (OLED), through a p-type drive transistor. In one example, an input signal, such as a low "SCAN" signal, is employed to switch transistors in the circuit to permit a data voltage, VDAT, to be stored at a storage capacitor during a programming phase. When the SCAN signal is high and the switch transistors isolate the circuit from the data voltage, the VDAT voltage is retained by the capacitor, and this voltage is applied to a gate of a drive transistor. With the drive transistor having a threshold voltage $V_{TH}$, the amount of current to the OLED is related to the voltage on the gate of the drive transistor by:

$$I_{OLED} = \frac{\beta}{2}(V_{DAT} - V_{DD} - V_{TH})^2$$

where $V_{DD}$ is a power supply connected to the source of the drive transistor.

TFT device characteristics, especially the TFT threshold voltage $V_{TH}$, may vary with time or among comparable devices, for example due to manufacturing processes or stress and aging of the TFT device over the course of operation. With the same VDAT voltage, therefore, the amount of current delivered by the drive TFT could vary by a significant amount due to such threshold voltage variations. Therefore, pixels in a display may not exhibit uniform brightness for a given VDAT value.

Conventionally, therefore, OLED pixel circuits have high tolerance ranges to variations in threshold voltage and/or carrier mobility of the drive transistor by employing circuits that compensate for mismatch in the properties of the drive transistors. For example, an approach is described in U.S. Pat. No. 7,414,599 (Chung et al., issued Aug. 19, 2008), which describes a circuit in which the drive TFT is configured to be a diode-connected device during a programming period, and a data voltage is applied to the source of the drive transistor.

The threshold compensation time is dictated by the drive transistor's characteristics, which may require a long compensation time for high compensation accuracy. For the data programming time, the RC constant time required for charging the programming capacitor is determinative of the programming time. As is denoted in the art, the one horizontal (1H) time is the time that it takes for the data to be programmed for one row.

With such circuit configuration as in U.S. Pat. No. 7,414,599, the data is programmed at the same time as when the threshold voltage of the drive transistor is compensated. It is desirable, however, to have as short of a one horizontal time as possible to enhance the responsiveness and operation of the display device. This is because each row must be programmed independently, whereas other operations, such as for example drive transistor compensation, may be performed for multiple rows simultaneously. The responsiveness of the display device, therefore, tends to be dictated most by the one horizontal time for programming. When the data is programmed during the same operational phase that the drive transistor is compensated, the one horizontal time cannot be reduced further due to compensation accuracy requirements for the drive transistor, as the compensation requirements limit any time reductions for the programming phase.

Another drawback of circuit configurations comparably as described in U.S. Pat. No. 7,414,599 is that a voltage variation at the power supply line, such as the IR drop at the power supply ELVDD line, will affect the OLED current. At the end of the data programming and compensation phase, the stored voltage across the capacitor is:

$$V_{DD_{PROG}}(V_{DAT}|V_{TH}|)$$

where $V_{DD_{PROG}}$ is the ELVDD voltage at the end of the programming and compensation phase, which is applied to a first plate of the storage capacitor. $V_{DAT}-|V_{TH}|$ is the programmed and compensated voltage stored at a second plate of the storage capacitor.

Another approach is described in U.S. Ser. No. 10/192,481 (Cho et al., issued Jan. 29, 2019). In such circuit, a two-capacitor structure is used to enable the pixel circuit to operate at higher refresh rates. Using two capacitors allows for separation of the compensation phase from the programming phase. Because the compensation phase is independent of the programming phase, a longer compensation time can be allocated to the compensation phase, resulting in much better compensation performance. This topology, however, has a deficiency in that during emission, due to parasitic capacitances of the switching elements, compensation performance is degraded.

Another approach is described in US 2019/0147799 (Kim et al., published May 16, 2019). The threshold voltage of the drive transistor is first compensated and stored on a capacitor. The compensation phase ends when a switching transistor connecting the drain and gate of the drive transistor is turned off. During that time the channel of said switching transistor is removed and the charge carriers that formed the channel are stored in the gate node of the drive transistor. These same charge carriers are then used to create a channel for a compensation transistor, hence removing the effect of said excess charge in the gate node of the drive transistor. The compensation transistor acts as a varactor, i.e. a variable capacitor, in this configuration. This approach does not compensate for the total parasitic capacitances of overall the pixel circuit, however, resulting in inferior performance.

SUMMARY OF INVENTION

Embodiments of the present application relate to pixel circuits that have improved compensation performance by utilizing an additional compensation element in form of a variable capacitor (varactor). The use of the variable capacitor (varactor) results in enhanced compensation performance that otherwise may be degraded from a variety of sources. For example, after the compensation phase, switching activity of the switch transistors skews and degrades compensation performance. Some pixel circuits have a short compensation time to run at higher frequencies, resulting in insufficient compensation performance. Undesired parasitic capacitive coupling between voltage nodes also can result in degraded compensation performance. Such deficient effects are rendered negligible by the use of the variable capacitor (varactor) in accordance with embodiments of the present application.

Embodiments of the present application provide pixel circuits for high refresh rate requirements, such as for 120 Hz applications. For such applications, an ultra-short 1H time (<2 μs) is achieved via separation of threshold compensation of the drive transistor and data programming phases. The threshold compensation time is dictated by the drive transistor characteristics and is difficult to reduce further without degrading the compensation accuracy. By further utilizing a varactor, compensation accuracy can be improved to a sufficient level for enhanced implementation. As referenced above, the RC constant time required for charging the programming capacitor is determinative of the programming time, and such programming time can be reduced to ultra-short 1H times (<2 μs).

In contrast to a typical capacitor as used in conventional configurations, the varactor used in embodiments of the current application has a charge capacity that is variable. The charge capacity of the varactor is a function of the voltage applied to the control terminals of the varactor. The variability of the charge capacity of the varactor can be used to track different threshold voltage values of the drive transistor. Different threshold values of the drive transistor lead to different node voltages of the pixel compensation circuit. The different voltage values change the charge capacity of the varactor, which in turn affects the node voltages of the pixel circuit. By selecting an appropriate capacity range for the varactor, compensation performance is improved, which accounts for variations in the threshold voltage of the drive transistor, which can derive from parasitic capacitances present in the pixel circuit.

In exemplary embodiments of the present application, a pixel circuit uses a two-capacitor structure. A first storage capacitor is used for the threshold compensation during the compensation phase, and a second capacitor is used to program a data voltage onto the first capacitor after the compensation phase, during the programming phase. The threshold compensation and data programming operations are thereby independent of each other, and thus a short one horizontal time can be achieved with a short data programming phase. The short one horizontal time improves the responsiveness of the OLED. However, due to unwanted capacitive coupling between the first storage capacitor and other parasitic capacitances, such as parasitic capacitances of the switching elements, compensation performance can be degraded and therefore become insufficient. The varactor as employed in various embodiments of the current application improves the compensation performance by compensating for various parasitic capacitances within the pixel circuit, such that the circuit can operate in an enhanced manner.

An aspect of the invention, therefore, is a pixel circuit for a display device operable in an initialization phase, a compensation phase, a data programming phase, and an emission phase, whereby the one horizontal time is minimized while maintaining accurate compensation of the threshold voltage of the drive transistor, and further employing a varactor to compensate for variations in the threshold voltage of the drive transistor due to parasitic capacitances that arise within the pixel circuit. In exemplary embodiments, the pixel circuit includes a drive transistor configured to control an amount of current to a light-emitting device during an emission phase depending upon a voltage applied to a gate of the drive transistor, the drive transistor having a first terminal that is connected to a first voltage supply line and having a second terminal opposite from the first terminal; a first capacitor having a first plate connected to the gate of the drive transistor and having a second plate that is electrically connected to the second terminal of the drive transistor during a compensation phase in which a threshold voltage of the drive transistor is compensated; a light-emitting device that is electrically connected at a first terminal to the second terminal of the drive transistor during the emission phase and at a second terminal to a second voltage supply line; and a varactor having a first terminal connected to a control line and having a second terminal that is electrically connected to the second terminal of the drive transistor during the compensation phase. A capacitance of the varactor varies with a voltage at a node N1 constituting an electrical connection during the compensation phase of the second terminal of the drive transistor, the first terminal of the light-emitting device, the second plate of the first capacitor, and the second terminal of the varactor to account for a variation in the threshold voltage of the drive transistor and for parasitic capacitances in the pixel circuit. The varactor may be implemented as a thin film transistor (TFT) that operates as a variable capacitor.

In exemplary embodiments, the pixel circuit further may include a first switch transistor having a first terminal connected to the second terminal of the drive transistor and a second terminal connected to the node N1, wherein the first switch transistor is placed in an on state during the compensation phase to electrically connect the node N1 to the second terminal of the drive transistor. The pixel circuit further may include a second switch transistor having a first terminal connected to an initialization voltage supply line and a second terminal connected to the node N1, wherein during an initialization phase the second switch transistor is in an on state to apply an initialization voltage from the initialization voltage supply line to the node N1 to reset a voltage at the first terminal of the light-emitting device; a third switch transistor having a first terminal connected to a reference voltage supply line and having a second terminal connected to a node N2 that is a connection of the first plate of the first capacitor and the gate of the drive transistor, wherein during the initialization phase and the compensation phase the third switch transistor is in an on state to apply a reference voltage from the reference voltage supply line to the node N2; a fourth switch transistor having a first terminal connected to a data voltage supply line and a second terminal connected to the node N2, wherein during a data programming phase the fourth switch transistor is in an on state to apply a data voltage from the data voltage supply line to the node N2; and a second capacitor having a first plate connected to the node N1 and a second plate connected to an input voltage supply.

Another aspect of the invention is method of operating a pixel circuit according to any of the embodiments, whereby the one horizontal time is minimized while maintaining accurate compensation of the threshold voltage of the drive transistor, and further employing a varactor to compensate for variations in the threshold voltage of the drive transistor due to parasitic capacitances that arise within the pixel circuit. In exemplary embodiments, the method of operating includes the steps of providing a pixel circuit according to any of the embodiments; performing a compensation phase to compensate the threshold voltage of the drive transistor comprising applying a reference voltage from a reference voltage supply line to the gate of the drive transistor, and electrically connecting the second terminal of the varactor to the second terminal of the drive transistor; wherein a capacitance of the varactor varies with a voltage at a node N1 constituting an electrical connection during the compensation phase of the second terminal of the drive transistor, the first terminal of the light-emitting device, the second plate of the first capacitor, and the second terminal of the varactor to account for a variation in the threshold voltage of the drive transistor and for parasitic capacitances in the pixel circuit; and performing an emission phase during which light is emitted from the light-emitting device by electrically connecting the first terminal of the light-emitting device to the second terminal of the drive transistor and applying a driving voltage from the first voltage supply line to the light-emitting device. The method of operating further may include performing a data programming phase comprising disconnecting the reference voltage supply line from the pixel circuit, and applying a data voltage from a data voltage supply line to the gate of the drive transistor; and performing an initialization phase comprising applying an initialization voltage from an initialization voltage supply line to the first terminal of the light-emitting device, and applying the reference voltage to the gate of the drive transistor.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DESCRIPTION OF EMBODIMENTS

Figure 1:
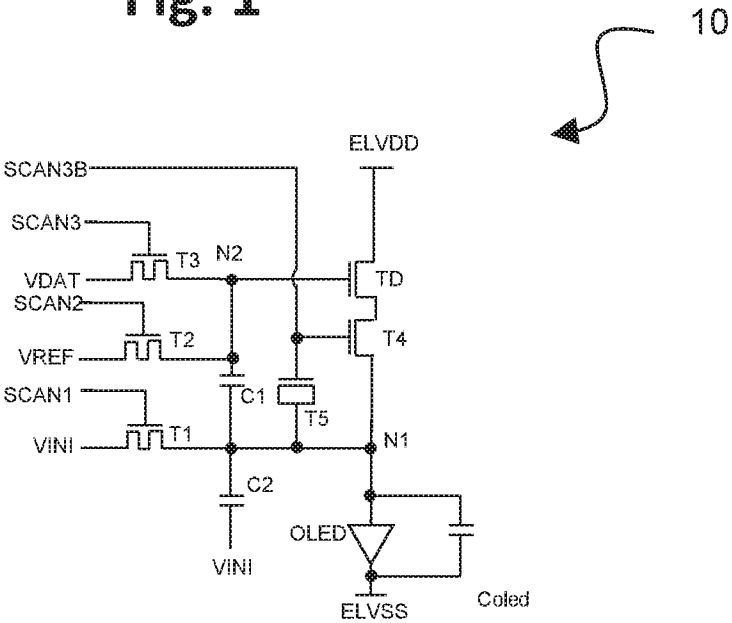
FIG. 1 is a drawing depicting a first circuit configuration in accordance with embodiments of the present application.

Embodiments of the present application will now be described with reference to the drawings, wherein like reference numerals are used to refer to like elements throughout. It will be understood that the figures are not necessarily to scale.

Figure 2:
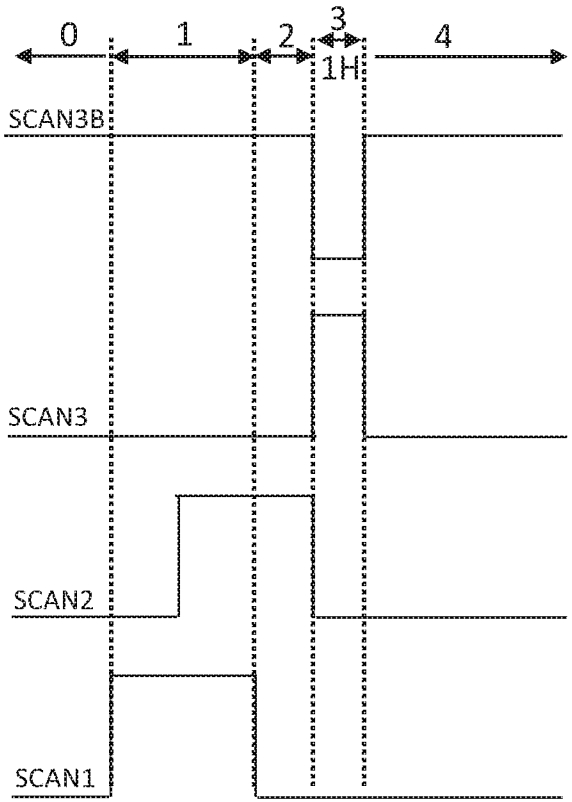
FIG. 2 is a drawing depicting a timing diagram associated with the operation of the circuit of FIG. 1.

FIG. 1 is a drawing depicting a first circuit configuration 10 in accordance with embodiments of the present application, and FIG. 2 is a timing diagram associated with the operation of the circuit configuration 10 of FIG. 1. In this example, the circuit 10 is configured as a thin film transistor (TFT) circuit that includes multiple n-type transistors TD, T1, T2, T3, T4, T5 and two capacitors C1 and C2. The circuit elements drive a light-emitting device, such as for example an OLED. The light-emitting device (OLED) has an associated internal capacitance, which is represented in the circuit diagram as $C_{oled}$. In addition, although the embodiments are described principally in connection with an OLED as the light-emitting device, comparable principles may be used with display technologies that employ other types of light-emitting devices, including for example micro LEDs and quantum dot LEDs. Transistors T1, T2, and T3 may be implemented as low temperature polycrystalline silicon (LTPS) transistors having a double gate configuration, or as ultra-low leakage transistors such as indium gallium zinc oxide (IGZO) transistors, to reduce leakage.

More specifically, FIG. 1 depicts the TFT circuit 10 configured with multiple n-MOS or n t-type TFTs. TD is a drive transistor that is an analogue TFT that is connected to a source voltage supply line that supplies a driving voltage ELVDD, and T1-T4 are digital switch TFTs. T5 is an analogue TFT configured to function as a variable capacitor, also referred to herein and in the art as a varactor, which has a first terminal, also referred to as the gate terminal of T5, connected to a control line (e.g., the SCAN3B line in the embodiment of FIG. 1) and has a second terminal opposite from the first terminal. As referenced above, C1 and C2 are capacitors, with C1 also being referred to as the storage capacitor and C2 being referred to as the programming capacitor. $C_{oled}$ is the internal capacitance of the OLED device (i.e., $C_{oled}$ is not a separate component, but is inherent to the OLED). The OLED further is connected to another voltage supply line that inputs a power supply ELVSS as is conventional.

The OLED and the TFT circuit 10, including the transistors, capacitors and connecting wires, may be fabricated using TFT fabrication processes conventional in the art. It will be appreciated that comparable fabrication processes may be employed to fabricate the TFT circuits according to any of the embodiments.

For example, the TFT circuit 10 (and subsequent embodiments) may be disposed on a substrate such as a glass, plastic, or metal substrate. Each TFT may comprise a gate electrode, a gate insulating layer, a semiconducting layer, a first electrode, and a second electrode. The semiconducting layer is disposed on the substrate. The gate insulating layer is disposed on the semiconducting layer, and the gate electrode may be disposed on the insulating layer. The first electrode and second electrode may be disposed on the insulating layer and connected to the semiconducting layer using vias. The first electrode and second electrode respectively may commonly be referred to as the "source electrode" and "drain electrode" of the TFT. The capacitors may include a first electrode, an insulating layer and a second electrode, whereby the insulating layer forms an insulating barrier between the first and second electrodes. Wiring between components in the circuit, and wiring used to introduce signals to the circuit (e.g. SCAN1, SCAN2, SCAN3, SCAN3B, VREF, VINI, VDAT) may include metal lines or a doped semiconductor material. For example, metal lines may be disposed between the substrate and the gate electrode of a TFT, and connected to electrodes using vias. The semiconductor layer may be deposited by chemical vapour deposition, and metal layers may be deposited by a thermal evaporation technique.

The OLED device may be disposed over the TFT circuit. The OLED device may include a first electrode (e.g. anode of the OLED), which is connected to transistors T1, T4 and T5 in this example, one or more layers for injecting or transporting charge (e.g. holes) to an emission layer, an emission layer, one or more layers for injecting or transporting electrical charge (e.g. electrons) to the emission layer, and a second electrode (e.g. cathode of the OLED), which is connected to power supply ELVSS in this example. The injection layers, transport layers and emission layer may be organic materials, the first and second electrodes may be metals, and all of these layers may be deposited by a thermal evaporation technique.

Referring to the TFT circuit 10 of FIG. 1 in combination with the timing diagram of FIG. 2, the TFT circuit 10 operates to perform in four phases: initialization, compensation, programming, and emission phases. Such phases are labelled in the timing diagram of FIG. 2, with phase "0" denoting a previous emission phase. The time period for performing the programming phase is referred to in the art as the "one horizontal time" or "1H" time as illustrated in the timing diagram and in subsequent the timing diagrams. A short 1H time is a requirement for displays with a large number of pixels in a column, as is necessary for high-resolution displays and for high refresh rates such as used for 120 Hz applications. As referenced above, a short one horizontal time is significant because each row must be programmed independently, whereas other operations, such as for example drive transistor threshold compensation, may be performed for multiple rows simultaneously. The responsiveness of the device, therefore, tends to be dictated most by the one horizontal time for programming.

In this first embodiment, during the previous emission phase, the SCAN3B control signal has a high voltage level, so transistor T4 is on and the light-emitting device is electrically connected to the drive transistor. Light emission is being driven by the input driving voltage ELVDD connected to the drive transistor TD, whereby the actual current applied to the OLED is determined by the gate-source voltage of the drive transistor. Control signals SCAN1, SCAN2 and SCAN3 are at low voltage levels, and thus switch transistors T1, T2 and T3 are in the off state.

At the beginning of the initialization phase, the SCAN1 signal level is changed from a low voltage value to a high voltage value, causing switch transistor T1 to be switched to the on state. As transistor T1 is turned on, an initialization voltage VINI is applied from an initialization voltage supply line through T1 to the anode of the OLED. The initialization voltage VINI is set to lower than the threshold voltage of the OLED plus ELVSS, and thus the VINI voltage does not cause light emission when applied at anode of the OLED.

Further during the initialization phase, the SCAN2 signal level is changed from a low voltage value to a high voltage value, causing switch transistor T2 to be switched to the on state. As transistor T2 is turned on, a reference voltage VREF is applied from a reference voltage supply line through T2 to the gate of the drive transistor TD, which also is connected to the first (top) plate of the storage capacitor C1, referred to in FIG. 1 as the node N2. The application of the VREF reference voltage to the gate of the drive transistor, and to the first plate of the storage capacitor C1 in the various embodiments, operates to clear memory effects from the previous frame and to set a defined value for the gate-source voltage of the drive transistor TD for the subsequent compensation phase.

The TFT circuit 10 next is operable in a threshold compensation phase, during which the threshold voltage of the drive transistor TD is compensated. For such phase, the SCAN1 signal level is changed from a high voltage value to a low voltage value, which turns the transistor T1 off. As referenced above, the switch transistor T4 still is in the on state from the previous emission phase. As identified in FIG. 1, a node N1 is an electrical connection of the second terminal (source) of the drive transistor TD, the anode of the light-emitting device, the bottom plate of the first capacitor C1, and the second terminal of the varactor T5. At this phase, the node N1 is floating as the OLED is turned off by the VINI voltage. The drive transistor TD will conduct current to the node N1 until the source voltage of the drive transistor is high enough to turn off the drive transistor. The voltage at node N1 after TD is turned off for compensation is:

$$V_{N1}=V_{REF}-V_{THDRIVE}$$

where $V_{THDRIVE}$ is the threshold voltage of the drive transistor TD.

To keep N1 floating during the compensation, the reference voltage should also satisfy the following equation:

$$V_{REF}-V_{THDRIVE}<V_{OLED}+V_{ELVSS}$$

Preferably, to have effective voltage threshold compensation of the drive transistor TD, the initial voltage difference between the source of the drive transistor and the gate of the drive transistor should be:

$$V_{REF}-V_{VINI}>|V_{THDRIVE}|+\Delta V,$$

where ΔV is a voltage that is large enough to generate a high initial current to charge the storage capacitor C1 within an allocated threshold compensation time. The value of ΔV will depend on the properties of the transistors. For example, ΔV would be at least 3 volts for exemplary low-temperature polycrystalline silicon thin film transistor processes. The reference voltages VREF and VINI are set to satisfy this voltage requirement.

At the end of the threshold compensation phase, the control signal SCAN2 and SCAN3B signal levels are changed from a high voltage to a low voltage, which turns transistors T2 and T4 off. Control signal SCAN3 is changed from a low voltage to a high voltage, which switches transistor T3 to the on state. Transistor T4 is now off, and thus even if VDAT is set higher than VREF, the gate-source voltage of the drive transistor TD is therefore above TD's threshold voltage, and a current flows from TD to N1. This increases the voltage at node N1, which in turn reduces the target voltage to be programmed on the storage capacitor.

With the SCAN3 control signal level high, operation next proceeds to the data programming phase in which a data voltage is applied from a data voltage supply line through T3 to the gate of the drive transistor TD. With T3 being on, the data voltage input VDAT supply line is electrically connected to the gate of the drive transistor TD through T3. The voltage at node N1 changes to the following value:

$$V_{N1}=\frac{C_1}{C_2+C_1}(V_{DAT}-V_{REF})+V_{VREF}-V_{THDRIVE}$$

Therefore, the voltage stored on the storage capacitor C1 is as follows:

$$V_{GSDRIVE} = V_{DAT} - \frac{C_1}{C_2 + C_1}(V_{DAT} - V_{REF}) - V_{VREF} + V_{THDRIVE}$$

$$V_{GSDRIVE} = \frac{C_2}{C_2 + C_1}(V_{DAT} - V_{REF}) + V_{THDRIVE}$$

Before the programming phase, SCAN3B is at a high voltage value, and therefore the gate (the first terminal) of the varactor, transistor T5, is at a high voltage value. As a result, a conducting channel between the drain and source is formed below the gate of T5, and therefore the total gate capacitance of T5 is high. When the SCAN3B signal transitions from a high voltage value to a low voltage at the beginning of the programming phase, the gate of the varactor is at a low voltage value. As result, the conducting channel between the drain and source below the gate of T5 is removed, which reduces transistor T5's total gate capacitance. Such transition from a high total gate capacitance to a low total gate capacitance occurs when a formed channel is removed in a TFT. The channel in a TFT is formed when the gate-source voltage of the TFT is higher than its threshold voltage and is removed when the gate-source voltage of the TFT is lower than its threshold voltage. The gate-source voltage of the varactor T5 is as follows:

$$V_{GST5} = V_{SCAN3B} - V_{N1}$$

$$V_{GST5} = V_{SCAN3B} - \frac{C_1}{C_2 + C_1}(V_{DAT} - V_{REF}) - V_{VREF} + V_{THDRIVE}$$

where $V_{GST5}$ is the gate-source voltage of the varactor T5, and where $V_{SCAN3B}$ is the node voltage at the node where SCAN3B is inputted.

$V_{THDRIVE}$ can be rewritten as follows:

$$V_{THDRIVE} = V_{TH0} + \Delta V_{TH}$$

where $V_{TH0}$ is the threshold voltage of the ideal drive transistor that has no threshold voltage variation, and where $\Delta V_{TH}$ is the threshold voltage deviation from the ideal drive transistor.

Two different cases for the threshold voltage of the drive transistor, denoted Case A and Case B, can be defined:

In a Case A, the drive transistor has no threshold variation, and hence:

$$V_{THDRIVE} = V_{TH0}$$

$$V_{GST5a} = V_{SCAN3B} - \frac{C_1}{C_2 + C_1}(V_{DAT} - V_{REF}) - V_{VREF} + V_{TH0}$$

In a Case B, the drive transistor has a threshold variation, and hence:

$$V_{THDRIVE} = V_{TH0} + \Delta V_{TH}$$

$$V_{GST5b} = V_{SCAN3B} - \frac{C_1}{C_2 + C_1}(V_{DAT} - V_{REF}) - V_{VREF} + V_{TH0} + \Delta V_{TH}$$

$$V_{GST5b} = V_{GST5a} + \Delta V_{TH}$$

A voltage value $V_x$ can be defined with the property $V_{GST5a} \geq V_x$ that defines a condition in which the channel in varactor T5 is formed, and $V_{GST5a} < V_x$ defines a condition in which a channel in varactor T5 is not formed. Therefore, it follows that for Case B, when $V_{GST5b} \geq V_x - \Delta V_{TH}$ the channel in varactor T5 is formed, and when $V_{GST5b} < V_x - \Delta V_{TH}$ the channel in varactor T5 is not formed.

Figure 8:
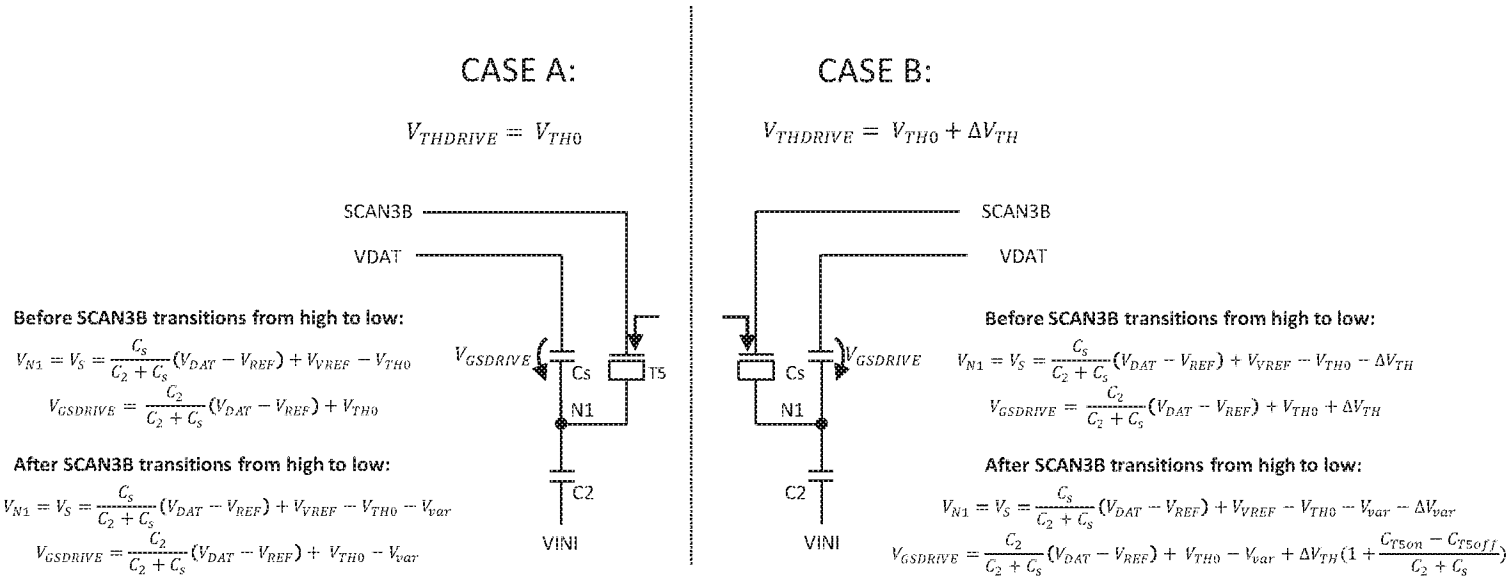
FIG. 8 is a drawing depicting the capacitive feedthrough of the varactor transistor for different threshold voltages.

Looking from the node of the input of SCAN3B into the varactor T5, varactor T5 is in series with the parallel combination of C1 and C2, as shown in FIG. 8. Based on the depiction in FIG. 8 as to Case A and Case B, the voltage change at the node N1 connected to the light-emitting device after the voltage change from high voltage to low voltage of SCAN3B is as follows:

CASE A:

$$\Delta V_{N1a} = V_{var} = -\left(\frac{C_{T5on}}{C_2 + C_1 + C_{T5on}}(V_{SCAN3BH} - V_x) + \frac{C_{T5off}}{C_2 + C_1 + C_{T5off}}(V_x - V_{SCAN3BL})\right)$$

CASE B:

$$\Delta V_{N1b} = -\left(\frac{C_{T5on}}{C_2 + C_1 + C_{T5on}}(V_{SCAN3BH} - (V_x - \Delta V_{TH})) + \frac{C_{T5off}}{C_2 + C_1 + C_{T5off}}((V_x - \Delta V_{TH}) - V_{SCAN3BL})\right)$$

It follows:

$$\Delta V_{var} = \Delta V_{N1b} - \Delta V_{N1a} = -\Delta V_{TH}\frac{C_{T5on}}{C_2 + C_1 + C_{T5on}} + \Delta V_{TH}\frac{C_{T5off}}{C_2 + C_1 + C_{T5off}}$$

If $C_2 + C_1 \gg C_{T5on}$ and $C_2 + C_1 \gg C_{T5off}$ then:

$$\Delta V_{var} = \Delta V_{N1b} - \Delta V_{N1a} \approx -\left(\Delta V_{TH}\frac{C_{T5on} - C_{T5off}}{C_2 + C_1}\right)$$

$$\Delta V_{N1b} \approx V_{var} + \Delta V_{var}$$

where $C_{T5on}$ is the gate capacitance of varactor T5 when a channel is formed, where $C_{T5off}$ is the gate capacitance of varactor T5 when a channel is not formed, where $V_{SCAN3BH}$ is the high voltage level of the signal SCAN3B, where $V_{SCAN3BL}$ is the low voltage level of the signal SCAN3B, where $V_{var}$ is the voltage change of N1 due to capacitive feedthrough of SCAN3B through T5, and where $\Delta V_{var}$ is the excess voltage generated due to a threshold variation of the drive transistor TD.

When there is a threshold variation in the drive transistor TD, the varactor T5 will generate an excess voltage $\Delta V_{var}$. The calculations that follow are performed under the presumed condition that a threshold variation in the drive transistor is present (i.e., Case B). Under such condition, the voltage stored on the storage capacitor C1 is as follows:

$$V_{GSDRIVE} = \frac{C_2}{C_2 + C_1}(V_{DAT} - V_{REF}) + V_{TH0} + \Delta V_{TH} - \Delta V_{N1b}$$

$$V_{GSDRIVE} = \frac{C_2}{C_2 + C_1}(V_{DAT} - V_{REF}) + V_{TH0} + \Delta V_{TH} - V_{var} - \Delta V_{var}$$

-continued $$V_{GSDRIVE} = \frac{C_2}{C_2+C_1}(V_{DAT}-V_{REF})+V_{TH0}-V_{var}+\Delta V_{TH}\left(1+\frac{C_{T5on}-C_{T5off}}{C_2+C_1}\right)$$

The voltage difference $\Delta V_{var}$ is used to cancel parasitic capacitance effects, as described in more detail in connection with the operation of the subsequent emission phase. The emission phase starts when SCAN3B is switched from a low voltage to a high voltage, and transistor T4 is turned on to electrically connect the light-emitting device (OLED) to the drive transistor TD. Assuming the voltage at the anode of the OLED is solely defined by the voltage-current property of the OLED device and the programmed current of the drive transistor. Therefore, the voltage at the node N1 changes as follows:

From:

$$V_{N1previous} = \frac{C_1}{C_2+C_1}(V_{DAT}-V_{REF})+V_{VREF}-V_{TH0}-\Delta V_{TH}-\Delta V_{N1b}$$

$$V_{N1previous} = \frac{C_1}{C_2+C_1}(V_{DAT}-V_{REF})+V_{VREF}-V_{TH0}+\Delta V_{TH}+V_{var}+\Delta V_{var}$$

$$V_{N1previous} = \frac{C_1}{C_2+C_1}(V_{DAT}-V_{REF})+V_{VREF}-\Delta V_{TH}\left(1+\frac{C_{T5on}-C_{T5off}}{C_2+C_1}\right)$$

To:

$$V_{N1}=V_{OLED(I_d)}=V_{OLED}$$

where $I_d$ is the current programmed to the drive transistor, which is defined by the stored $V_{GSDRIVE}$ voltage stored in the storage capacitor C1, and where $V_{OLED}$ is the corresponding required voltage value at the anode of the OLED corresponding to the programmed current.

Figure 9:
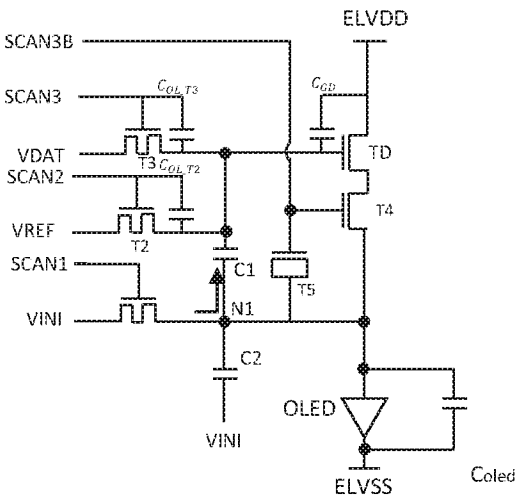
FIG. 9 is a drawing depicting parasitic capacitances of switching elements and the drive transistor.

During the emission phase, looking from the node N1 to C1, the top plate of the capacitor C1 is in series with three parallel parasitic capacitances as shown in FIG. 9. The total capacitance of the parallel combination of these parasitic capacitances is denoted $C_{par}$. As identified in FIG. 9, the three parasitic capacitances include the following: $C_{OL_T3}$ is the overlap capacitance of switch transistor T3; $C_{OL_T2}$ is the overlap capacitance of the switch transistor T2; and $C_{GD}$ is the gate-drain capacitance of the drive transistor TD.

Hence, the storage capacitor C1 is in series with the parasitic capacitances resulting in a total parasitic capacitance $C_{par}$. Therefore, if the voltage at the gate of the drive transistor is denoted VG and the gate-source voltage of the drive transistor is denoted $V_{GSDRIVE}$, then the voltage stored on the storage capacitor C1 which also equals $V_{GSDRIVE}$ is as follows: (assuming the voltage drop across T4 is negligible):

$$V_{GSDRIVE} = V_G - V_{N1}$$

$$V_G = V_{DATA} + \frac{C_1}{C_1+C_{par}}(V_{OLED}-V_{N1previous})$$

$$V_{N1} = V_{OLED}$$

$$V_{GSDRIVE} = V_{DATA} + \frac{C_1}{C_1+C_{par}}(V_{OLED}-V_{N1previous}) - V_{OLED}$$

$$V_{GSDRIVE} = V_{DATA} - \frac{C_{par}}{C_1+C_{par}}V_{OLED} - \frac{C_1}{C_1+C_{par}}V_{N1previous}$$

The threshold voltage of the drive transistor is stored only in the following term:

$$V_{N1previous}\left(\frac{C_1}{C_1+C_{par}}\right) = \left(\frac{C_1}{C_2+C_1}(V_{DATA}-V_{REF})+V_{VREF}-V_{TH0}-\Delta V_{TH}\left(1+\frac{C_{T5on}-C_{T5off}}{C_2+C_1}\right)\right)\left(\frac{C_1}{C_1+C_{par}}\right)$$

To cancel a variation in the threshold voltage of the drive transistor, $\Delta V_{TH}$, $$\text{“}V_{N1previous}\left(\frac{C_1}{C_1+C_{par}}\right)\text{”}$$

in the TFT-saturation-equation the term must exactly store one “$\Delta V_{TH}$”, or:

$$\Delta V_{TH} = \Delta V_{TH}\left(1+\frac{C_{T5on}-C_{T5off}}{C_2+C_1}\right)\left(\frac{C_1}{C_1+C_{par}}\right) = \Delta V_{TH}\left(1+\frac{C_{T5on}-C_{T5off}}{C_2+C_1}\right)\left(1-\frac{C_{par}}{C_1+C_{par}}\right)$$

Without the varactor T5 that acts as a variable capacitor, the above equation becomes:

$$\Delta V_{TH} = \Delta V_{TH}\left(1-\frac{C_{par}}{C_1+C_{par}}\right)$$

which cannot be established as a parasitic capacitance $C_{par}$ always exists. In other words, the variation in threshold voltage $\Delta V_{TH}$ of the drive transistor cannot be cancelled without use of the varactor.

Assuming $$\frac{C_{T5on}-C_{T5off}}{C_2+C_1} \ll 1$$

and $$\frac{C_{par}}{C_1+C_{par}} \ll 1$$

the following approximation can be made for the solution:

$$1 = 1+\frac{C_{T5on}-C_{T5off}}{C_2+C_1}-\frac{C_{par}}{C_1+C_{par}}$$

$$\frac{C_{T5on}-C_{T5off}}{C_2+C_1} = \frac{C_{par}}{C_1+C_{par}}$$

which yields the following equation for the sizing of the varactor T5:

$$C_{T5on} - C_{T5off} = \frac{C_{par} * (C_2 + C_1)}{C_1 + C_{par}}$$

Assuming $C_{T5off}$«$C_{T5on}$ and $C_{par}$«$C_1$ this equation can be further simplified:

$$C_{T5on} = \frac{C_{par} * (C_2 + C_1)}{C_1}$$

Based on such principles, for effective operation the varactor T5 is sized such that when a channel below the gate of the varactor T5 is formed, the total gate capacitance looking into the gate is $$\frac{C_{par} * (C_2 + C_1)}{C_1}.$$

For example, in this embodiment capacitors C1 and C2 are the same size, so the varactor T5 is sized such that:

$$C_{T5on}=2*C_{par}$$

As follows from the above description, when the threshold voltage of the drive transistor TD varies, the source voltage of the drive transistor at the node N1 will differ as a function of such threshold variation voltage. As also connected to the node N1, the varactor T5 also experiences such source voltage difference, and the amount of charge injected from the varactor to the node N1 likewise depends on the TD source voltage at N1. For example, when the voltage at N1 is higher than expected due to a TD threshold voltage variation, the varactor T5 shuts off sooner so there is a relatively lower charge injection. In contrast, when the voltage at N1 is lower than expected due to a TD threshold voltage variation, the varactor T5 shuts off later so there is a relatively higher charge injection. The channel created across the varactor, therefore, varies with the voltage at node N1 to compensate for any TD threshold voltage variation and associated parasitic capacitances.

During the emission phase, the current that flows through the OLED is:

$$I_{OLED} = \frac{\beta}{2}(V_{GSDRIVE} - V_{TH0} - \Delta V_{TH})^2$$

$$I_{OLED} = \frac{\beta}{2}\left(V_{DATA} - \frac{C_{par}}{C_1 + C_{par}} V_{OLED} - \frac{C_1}{C_1 + C_{par}}\left(\frac{C_1}{C_2 + C_1}(V_{DATA} - V_{REF}) + V_{VREF} - V_{TH0} - \Delta V_{TH}\left(1 + \frac{C_{T5on} - C_{T5off}}{C_2 + C_1}\right)\right) - V_{TH0} - \Delta V_{TH}\right)^2$$

$$I_{OLED} = \frac{\beta}{2}\left(\left(1 - \frac{C_1}{C_1 + C_{par}}\frac{C_1}{C_2 + C_1}\right)V_{DATA} - \frac{C_{par}}{C_1 + C_{par}} V_{OLED} - \frac{C_1}{C_1 + C_{par}}\frac{C_2}{C_1 + C_2} V_{VREF} - \frac{C_{par}}{C_1 + C_{par}} V_{TH0}\right)^2$$

where $$\beta = \mu_n \cdot C_{ox} \cdot \frac{W}{L},$$

$V_{TH0}$ is the threshold voltage of the ideal drive transistor with no threshold deviation; $C_{ox}$ is the capacitance of the drive transistor gate oxide;

W is the width of the drive transistor channel;

L is the length of the drive transistor channel (i.e. distance between source and drain); and $\mu_n$ is the carrier mobility of the drive transistor.

Hence the current to the OLED device $I_{OLED}$ is not affected by the threshold voltage variations of the drive transistor and the further threshold variations caused by parasitic capacitances. In this manner, variation in the threshold voltage of the drive transistor has been compensated. In addition, as described above the two-capacitor structure is used, whereby the first capacitor C1 is used for the threshold compensation during compensation phase, and the second capacitor C2 is used to scale the data voltage between the two capacitors during programming phase. The threshold compensation and data programming operations thus are independent of each other, and a short one horizontal time can be achieved with a short data programming phase.

Figure 3:
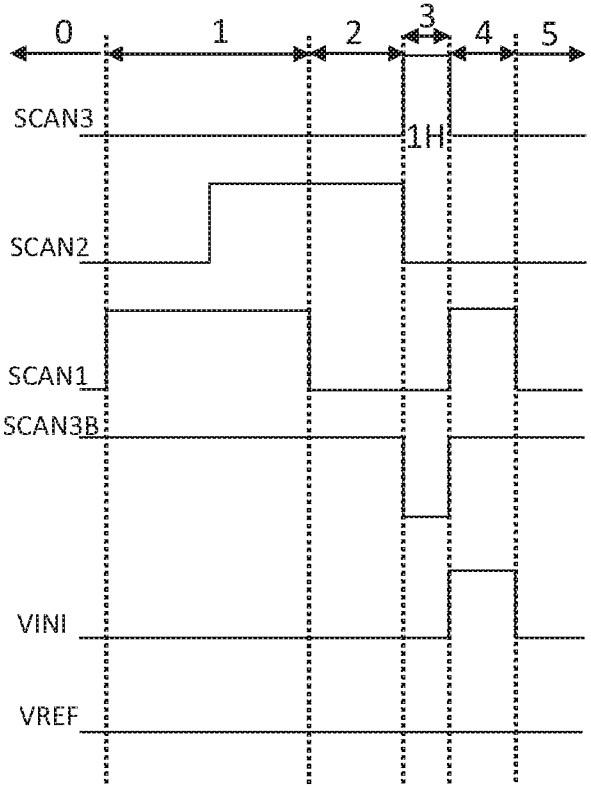
FIG. 3 is a drawing depicting an alternative timing diagram associated with the operation of the circuit of FIG. 1.

FIG. 3 is a drawing depicting a second timing diagram that is a variation of the timing diagram of FIG. 2. In the embodiment of FIG. 3, an additional reset phase is performed between the programming and emission phases to reset the voltage at the anode of the light-emitting device. This is done because during the compensation phase, the voltage at the anode of the light-emitting device can change, and so the anode voltage may be reset again prior to the emission phase. The embodiment of FIG. 3 has a particular advantage for use in low current conditions to improve the light emission start-up time at the beginning of the emission phase.

To perform the reset phase, an input voltage is applied from an input voltage supply line to the first terminal (anode) of the light-emitting device to reset a voltage at the first terminal of the light-emitting device. For example, in the embodiment of FIG. 3, during the "Reset Anode of OLED" phase as indicated in the figure, the SCAN1 signal goes high from low and turns on transistor T1 to apply the initialization voltage VINI from the initialization voltage supply line to the anode of the OLED through switch transistor T1. The VINI voltage is adjusted such that the voltage at the anode of the light-emitting device is set slightly below the threshold voltage of the OLED so that the light-emitting device can start up faster. The required start-up time for the light-emitting device is more critical in a pixel circuit running at 120 Hz as compared to 60 Hz due to the halved timeframe of operation.

Figure 4:
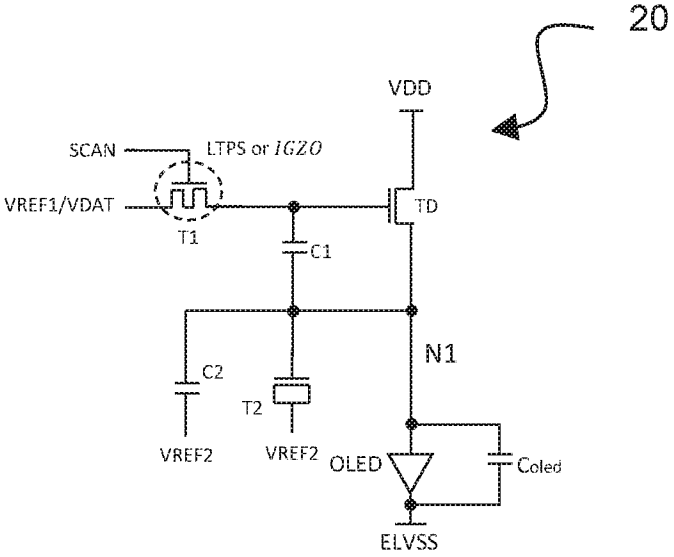
FIG. 4 is a drawing depicting a second circuit configuration in accordance with embodiments of the present application.
Figure 5:
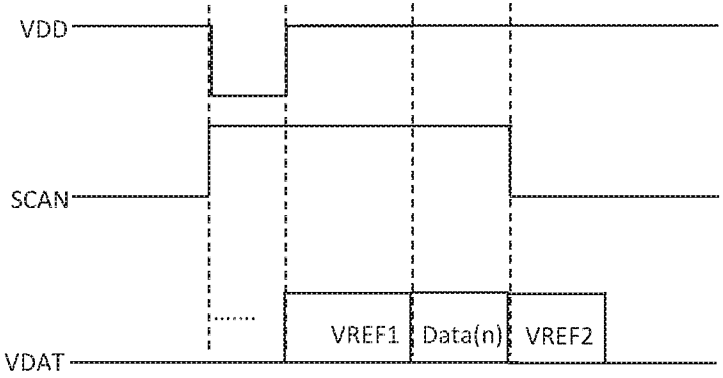
FIG. 5 is a drawing depicting a timing diagram associated with the operation of the circuit of FIG. 4.

FIG. 4 is a drawing depicting a second circuit configuration 20 in accordance with embodiments of the present application, and FIG. 5 is a timing diagram associated with the operation of the circuit configuration 20 of FIG. 4. The embodiment of FIG. 4 has a simpler circuit configuration as compared to the previous embodiment, having only a single switch transistor T1 that has a first terminal connected to a data voltage supply line and a second terminal connected to the gate of the drive transistor. In addition, circuit 20 has a varactor T2 that has a first terminal (the gate terminal) that is directly connected to the node N1, and a second terminal (source/drain terminal) that is connected to a reference voltage supply line. Without the additional switch transistors that are present in the previous embodiment, as further detailed below the circuit configuration 20 operates by modulation of the input voltages applied from the voltage supply lines. Although this embodiment constitutes a simpler circuit configuration, the embodiment of FIG. 1 has an advantage in that often it may be difficult to operate effectively by modulating the voltage supplies as done in the embodiment of FIG. 4.

Referring to the TFT circuit 20 of FIG. 4 in combination with the timing diagram of FIG. 5, the TFT circuit 20 also operates to perform in four phases: an initialization phase, a compensation phase, a data programming phase, and an emission phase for light emission. During the previous emission phase, the SCAN signal level has a low voltage value, so the transistor T1 is off, and light emission is being driven by the input driving voltage ELVDD connected to the drive transistor TD, whereby the actual current applied to the OLED is determined by the voltage at the gate and source of the drive transistor.

During the initialization phase, the SCAN signal level is changed from a low voltage value to a high voltage value, causing transistor T1 to be switched to an on state. The supply voltage ELVDD is set to a low voltage value to substantially eliminate the current through the drive transistor. In this embodiment, a first reference voltage VREF1 is applied from the data voltage supply line through T1 to the gate of the drive transistor, and thus the drive transistor sets the light-emitting device to the low voltage value of ELVDD to erase prior emission phase effects.

The TFT circuit 20 next is operable in a threshold compensation phase, during which the threshold voltage of the drive transistor TD is compensated. For such phase, the ELVDD signal level is changed from a low voltage value to a high voltage value, causing the drive transistor TD to inject a current into the anode of the light-emitting device until the source voltage value of the drive transistor is high enough to turn off the drive transistor. The voltage at node N1 after TD is turned off for compensation is:

$V_{N1}=V_{VREF1}\ V_{THDRIVE}$

Preferably, to have effective voltage threshold compensation of the drive transistor TD, the initial voltage difference between the source of the drive transistor and the diode-connected gate-drain of the drive transistor should satisfy the following condition:

$V_{VREF1}\ V_{DDlow}>|V_{TH}|+\Delta V$, where $V_{DDlow}$ is a low state voltage value of the control signal ELVDD and where $\Delta V$ is a voltage that is large enough to generate a high initial current to charge the storage capacitor within an allocated threshold compensation time. The value of $\Delta V$ will depend on the properties of the transistors. For example, $\Delta V$ would be at least 3 volts for exemplary low-temperature polycrystalline silicon thin film transistor processes. The first reference voltage VREF1 is set to satisfy this voltage requirement.

The TFT circuit 20 next is operable in a data programming phase. The VDAT input signal level is changed from the first reference voltage VREF1 to the data voltage value VDAT(n) to program the data voltage to the gate of the drive transistor. The gate-source voltage of drive transistor becomes:

$$V_{GSDRIVE} = \frac{C_2}{C_2 + C_1}(V_{DAT} - V_{REF1}) + V_{THDRIVE}$$

The TFT circuit 20 next is operable in an emission phase during which the OLED is capable of emitting light. The SCAN signal is changed from the high voltage value to the low voltage value, causing transistor T1 to turn off. The voltage at the anode of the light-emitting device rises until the anode sinks the same amount of current that is supplied by the drive transistor. The varactor T2 is connected at its second terminal to a second reference voltage supply line that supplies a second reference voltage VREF2 (which may or may not be the same voltage level as VREF1), and a channel between the drain and source is formed below the gate of the varactor similarly as described above when the anode of the light-emitting device reaches a high enough voltage level during compensation. Unlike in the circuit configuration 10 of FIG. 1, the varactor T2 in the circuit configuration 20 of FIG. 4 is connected to the second reference voltage VREF2 constituting a constant bias voltage. Analogous to the previous embodiment, the varactor T2 of FIG. 4 still compensates the performance degradation due to parasitic capacitances of the switch transistor T1 and the drive transistor TD in a manner comparably as described above.

The current that flows through the OLED is:

$$I_{OLED} = \frac{\beta}{2}(V_{GSDRIVE} - V_{THDRIVE})^2$$

$$I_{OLED} = \frac{\beta}{2}\left(\left(1 - \frac{C_1}{C_1 + C_{par}}\frac{C_1}{C_2 + C_1}\right)V_{DATA} - \frac{C_{par}}{C_1 + C_{par}}V_{OLED} - \frac{C_1}{C_1 + C_{par}}\frac{C_1}{C_1 + C_2}V_{VREF} - \frac{C_{par}}{C_1 + C_{par}}V_{TH0}\right)^2$$

where $$\beta = \mu_n \cdot C_{ox} \cdot \frac{W}{L},$$

$V_{TH0}$ is the threshold voltage of the ideal drive transistor with no threshold deviation;

$C_{ox}$ is the capacitance of the drive transistor gate oxide;

W is the width of the drive transistor channel;

L is the length of the drive transistor channel (i.e. distance between source and drain); and $\mu_n$ is the carrier mobility of the drive transistor.

Hence, the current to the OLED device $I_{OLED}$ also is not affected by the threshold voltage variations of the drive transistor similarly as in the previous embodiment by the operation of the varactor as to the parasitic capacitance $C_{par}$. In this manner, variation in the threshold voltage of the drive transistor has been compensated. In addition, the two-capacitor structure again is used, whereby the first capacitor C1 is used for the threshold compensation during the compensation phase, and the second capacitor C2 is used to scale the data voltage between the two capacitors during the programming phase. The threshold compensation and data programming operations thus are independent of each other, and a short one horizontal time can be achieved with a short data programming phase.

Figure 6:
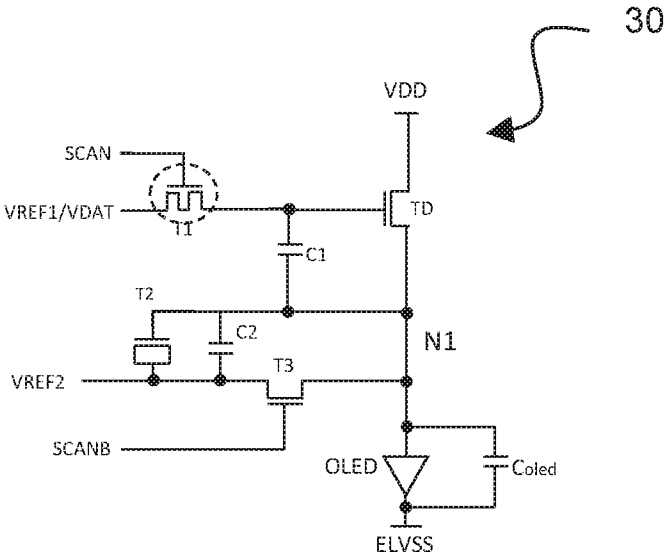
FIG. 6 is a drawing depicting a third circuit configuration in accordance with embodiments of the present application.
Figure 7:
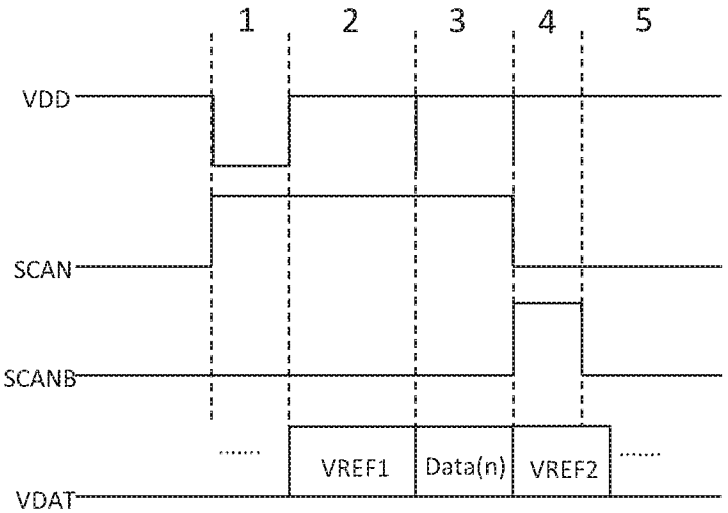
FIG. 7 is a drawing depicting a timing diagram associated with the operation of the circuit of FIG. 6.

FIG. 6 is a drawing depicting a third circuit configuration 30 in accordance with embodiments of the present application, and FIG. 7 is a timing diagram associated with the operation of the circuit configuration 30 of FIG. 6. The TFT circuit 30 of FIG. 6 operates in a manner similar to the circuit 20 of FIG. 4, and thus as seen in the timing diagram of FIG. 7, the applied voltages and SCAN signal are inputted comparably as shown in the timing diagram of FIG. 5. In the embodiment of FIG. 6, the circuit configuration 30 includes an additional switch transistor T3 that has a first terminal connected to the second reference voltage supply line that supplies the second reference voltage VREF2, and a second terminal connected to the node N1 connection of the anode of the OLED and the source of the drive transistor TD. The switch transistor T3 is operated by an additional control signal SCANB.

As shown in the timing diagram of FIG. 7, after the end of the programming phase an additional operational phase is performed, denoted as the "reset anode" phase. This phase is similar to the reset anode phase introduced in FIG. 3 in connection with the first embodiment, in which an input voltage is applied from an input voltage supply line to the first terminal of the light-emitting device to reset a voltage at the first terminal of the light-emitting device. For example, as depicted in FIG. 6 the input voltage may be the second reference voltage VREF2 applied from the reference voltage supply line. At the beginning of such reset anode phase, the signal SCANB changes from a low voltage value to a high voltage value, which switches transistor T3 to the on state. With T3 being on, the anode of the light-emitting device is electrically connected to the reference voltage supply line that supplies the second reference voltage VREF2, which operates to reset the voltage at the anode of the light-emitting device. Similarly as described above, this is done because during the compensation phase, the voltage at the anode of the light-emitting device can change, and so the anode voltage may be reset again prior to the emission phase. The embodiment of FIG. 7 also thus has a particular advantage for use in low current conditions to improve the light emission start-up time at the beginning of the emission phase. The VREF2 voltage is adjusted such that the voltage at the anode of the light-emitting device is set similarly as previous embodiment so that the light-emitting device can start up faster.

An aspect of the invention, therefore, is a pixel circuit for a display device operable in an initialization phase, a compensation phase, a data programming phase, and an emission phase, whereby the one horizontal time is minimized while maintaining accurate compensation of the threshold voltage of the drive transistor, and further employing a varactor to compensate for variations in the threshold voltage of the drive transistor due to parasitic capacitances that arise within the pixel circuit. In exemplary embodiments, the pixel circuit includes a drive transistor configured to control an amount of current to a light-emitting device during an emission phase depending upon a voltage applied to a gate of the drive transistor, the drive transistor having a first terminal that is connected to a first voltage supply line and having a second terminal opposite from the first terminal; a first capacitor having a first plate connected to the gate of the drive transistor; a light-emitting device that is electrically connected at a first terminal to the second terminal of the drive transistor during the emission phase and at a second terminal to a second voltage supply line; and a varactor having a first terminal connected to a control line and having a second terminal that is electrically connected to the second terminal of the drive transistor during the compensation phase. A capacitance of the varactor varies with a voltage at a node N1 constituting an electrical connection during the compensation phase of the second terminal of the drive transistor, the first terminal of the light-emitting device, and the second terminal of the varactor to account for a variation in the threshold voltage of the drive transistor. The pixel circuit may include one or more of the following features, either individually or in combination.

In an exemplary embodiment of the pixel circuit, a second plate of the first capacitor is electrically connected to the second terminal of the drive transistor during a compensation phase in which a threshold voltage of the drive transistor is compensated.

In an exemplary embodiment of the pixel circuit, the varactor is configured as a thin film transistor.

In an exemplary embodiment of the pixel circuit, the first terminal of the varactor is a gate terminal that is connected to the control line, and the second terminal of the varactor is a source/drain terminal that is connected to the node N1.

In an exemplary embodiment of the pixel circuit, the control line is one of a SCAN control signal line or a reference voltage supply line.

In an exemplary embodiment of the pixel circuit, the pixel circuit further includes a first switch transistor having a first terminal connected to the second terminal of the drive transistor and a second terminal connected to the node N1, wherein the first switch transistor is placed in an on state during the compensation phase to electrically connect the node N1 to the second terminal of the drive transistor.

In an exemplary embodiment of the pixel circuit, the pixel circuit further includes a second switch transistor having a first terminal connected to an initialization voltage supply line and a second terminal connected to the node N1, wherein during an initialization phase the second switch transistor is in an on state to apply an initialization voltage from the initialization voltage supply line to the node N1 to reset a voltage at the first terminal of the light-emitting device.

In an exemplary embodiment of the pixel circuit, the pixel circuit further includes a third switch transistor having a first terminal connected to a reference voltage supply line and having a second terminal connected to a node N2 that is a connection of the first plate of the first capacitor and the gate of the drive transistor, wherein during the initialization phase and the compensation phase the third switch transistor is in an on state to apply a reference voltage from the reference voltage supply line to the node N2.

In an exemplary embodiment of the pixel circuit, the pixel circuit further includes a fourth switch transistor having a first terminal connected to a data voltage supply line and a second terminal connected to the node N2, wherein during a data programming phase the fourth switch transistor is in an on state to apply a data voltage from the data voltage supply line to the node N2.

In an exemplary embodiment of the pixel circuit, the pixel circuit further includes a first switch transistor having a first terminal connected to a data voltage supply line and a second terminal connected to the gate of the drive transistor, wherein the first switch transistor is in an on state during both the compensation phase and during a data programming phase to apply respectively a first reference voltage and a data voltage from the data voltage supply line to the gate of the drive transistor. (FIG. 4 Embodiment)

In an exemplary embodiment of the pixel circuit, the pixel circuit further includes a second switch transistor having a first terminal connected to a reference voltage supply line and having a second terminal connected to the node N1, wherein the second switch transistor is in an on state during a reset phase to apply a second reference voltage from the reference voltage supply line to the first terminal of the light-emitting device to reset a voltage at the first terminal of the light-emitting device. (FIG. 6 Embodiment)

In an exemplary embodiment of the pixel circuit, the pixel circuit further includes a second capacitor having a first plate connected to the node N1 and a second plate connected to an input voltage supply.

In an exemplary embodiment of the pixel circuit, the light-emitting device is one of an organic light-emitting diode, a micro light-emitting diode (LED), or a quantum dot LED.

Another aspect of the invention is method of operating a pixel circuit according to any of the embodiments, whereby the one horizontal time is minimized while maintaining accurate compensation of the threshold voltage of the drive transistor, and further employing a varactor to compensate for variations in the threshold voltage of the drive transistor due to parasitic capacitances that arise within the pixel circuit. In exemplary embodiments, the method of operating includes the steps of providing a pixel circuit according to any of the embodiments; performing a compensation phase to compensate a threshold voltage of the drive transistor comprising applying a reference voltage from a reference voltage supply line to the gate of the drive transistor, and electrically connecting the second terminal of the varactor to the second terminal of the drive transistor; wherein a capacitance of the varactor varies with a voltage at a node N1 constituting an electrical connection during the compensation phase of the second terminal of the drive transistor, the first terminal of the light-emitting device, the second plate of the first capacitor, and the second terminal of the varactor to account for a variation in the threshold voltage of the drive transistor; and performing an emission phase during which light is emitted from the light-emitting device by electrically connecting the first terminal of the light-emitting device to the second terminal of the drive transistor and applying a driving voltage from the first voltage supply line to the light-emitting device. The method of operating may include one or more of the following features, either individually or in combination.

In an exemplary embodiment of the method of operating, the first terminal of the varactor is a gate terminal that is connected to the control line, and the second terminal of the varactor is a source/drain terminal that is connected to the node N1.

In an exemplary embodiment of the method of operating, the method of operating further includes performing a data programming phase comprising disconnecting the reference voltage supply line from the pixel circuit, and applying a data voltage from a data voltage supply line to the gate of the drive transistor.

In an exemplary embodiment of the method of operating, the method of operating further includes performing an initialization phase comprising applying an initialization voltage from an initialization voltage supply line to the first terminal of the light-emitting device, and applying the reference voltage to the gate of the drive transistor.

In an exemplary embodiment of the method of operating, the method of operating further includes, after the data programming phase, performing a reset phase comprising applying an input voltage from an input voltage supply line to the first terminal of the light-emitting device to reset a voltage at the first terminal of the light-emitting device.

In an exemplary embodiment of the method of operating, the method of operating further includes placing the switch transistor in an on state during the compensation phase to electrically connect the node N1 to the second terminal of the drive transistor.

In an exemplary embodiment of the method of operating, the pixel circuit further includes a second capacitor having a first plate connected to the node N1 and a second plate connected to an input voltage supply.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

INDUSTRIAL APPLICABILITY

Embodiments of the present application are applicable to many display devices to permit display devices of high resolution with effective threshold voltage compensation and true black performance. Examples of such devices include televisions, mobile phones, personal digital assistants (PDAs), tablet and laptop computers, desktop monitors, digital cameras, and like devices for which a high resolution display is desirable.

REFERENCE SIGNS LIST

10—first circuit configuration
20—second circuit configuration
30—third circuit configuration
OLED—organic light emitting diode (or generally light-emitting device)
C1—storage capacitor
$C_2$—programming capacitor
$C_{oled}$—internal capacitance of OLED
$C_{T5on}$—total gate capacitance of varactor when channel is formed
$C_{T5off}$—total gate capacitance of varactor when channel is not formed
$C_{OL_T3}$—overlap capacitance of T3
$C_{OL_T2}$—overlap capacitance of T2
$C_{GD}$—gate drain capacitance of TD
$C_{par}$—total parasitic capacitance
N1—Node 1 in the pixel circuits
N2—Node 2 in the pixel circuits
TD—drive transistor
T1-T4—digital switch transistors
VDAT—data voltage
ELVDD—power supply
ELVSS—power supply
VREF—reference voltage supply
VINI—initial voltage
SCAN—control signal

What is claimed is:

1. A method of operating a pixel circuit for a display device comprising the steps of:

providing a pixel circuit comprising:

a drive transistor configured to control an amount of current to a light-emitting device during an emission phase depending upon a voltage applied to a gate of the drive transistor, the drive transistor including a first terminal that is connected to a first voltage supply line and a second terminal opposite from the first terminal, wherein the second terminal is a source of the drive transistor;

a first capacitor having a first plate connected to the gate of the drive transistor a light-emitting device that is electrically connected at a first terminal to the second terminal of the drive transistor during the emission phase and at a second terminal to a second voltage supply line; and a varactor having a first terminal connected to a control line and having a second terminal connected to the second terminal of the drive transistor, and the varactor is electrically isolated from the gate of the drive transistor;

performing a compensation phase to compensate a threshold voltage of the drive transistor comprising applying a reference voltage from a reference voltage supply line to the gate of the drive transistor, and electrically connecting the second terminal of the varactor to the second terminal of the drive transistor;

wherein a capacitance of the varactor varies with a voltage at a node N1 constituting an electrical connection during the compensation phase of the second terminal of the drive transistor, the first terminal of the light-emitting device, the second plate of the first capacitor, and the second terminal of the varactor to account for a variation in the threshold voltage of the drive transistor; and performing an emission phase during which light is emitted from the light-emitting device by electrically connecting the first terminal of the light-emitting device to the second terminal of the drive transistor and applying a driving voltage from the first voltage supply line to the light-emitting device.

2. The method of operating of claim 1, wherein the first terminal of the varactor is a gate terminal that is connected to the control line, and the second terminal of the varactor is a) source/drain terminal that is connected to the node N1.

3. The method of operating of claim 2, wherein the pixel circuit further includes a switch transistor having a first terminal connected to the second terminal of the drive transistor and a second terminal connected to the node N1, the method of operating further comprising placing the switch transistor in an on state during the compensation phase to electrically connect the node N1 to the second terminal of the drive transistor.

4. The method of operating of claim 2, wherein the pixel circuit further comprises a second capacitor having a first plate connected to the node N1 and a second plate connected to an input voltage supply.

5. The method of operating of claim 1, further comprising performing a data programming phase comprising disconnecting the reference voltage supply line from the pixel circuit, and applying a data voltage from a data voltage supply line to the gate of the drive transistor.

6. The method of operating of claim 5, further comprising performing an initialization phase comprising applying an initialization voltage from an initialization voltage supply line to the first terminal of the light-emitting device, and applying the reference voltage to the gate of the drive transistor.

7. The method of operating of claim 6, further comprising, after the data programming phase, performing a reset phase comprising applying an input voltage from an input voltage supply line to the first terminal of the light-emitting device to reset a voltage at the first terminal of the light-emitting device.

8. A pixel circuit for a display device comprising:

a drive transistor configured to control an amount of current to a light-emitting device during an emission phase depending upon a voltage applied to a gate of the drive transistor, the drive transistor having a first terminal that is connected to a first voltage supply line and having a second terminal opposite from the first terminal, wherein the second terminal is a source of the drive transistor;

a first capacitor having a first plate connected to the gate of the drive transistor;

a light-emitting device that is electrically connected at a first terminal to the second terminal of the drive transistor during the emission phase and at a second terminal to a second voltage supply line; and a varactor having a first terminal connected to a control line and having a second terminal that is electrically connected to the second terminal of the drive transistor during the compensation phase, and the varactor is electrically isolated from the gate of the drive transistor;

wherein a capacitance of the varactor varies with a voltage at a node N1 constituting an electrical connection during the compensation phase of the second terminal of the drive transistor, the first terminal of the light-emitting device, and the second terminal of the varactor to account for a variation in the threshold voltage of the drive transistor.

9. The pixel circuit of claim 8, wherein a second plate of the first capacitor is electrically connected to the second terminal of the drive transistor during a compensation phase in which a threshold voltage of the drive transistor is compensated.

10. The pixel circuit of claim 8, wherein the varactor is configured as a thin film transistor.

11. The pixel circuit of claim 10, wherein the first terminal of the varactor is a gate terminal that is connected to the control line, and the second terminal of the varactor is a source/drain terminal that is connected to the node N1.

12. The pixel circuit of claim 8, wherein the control line is one of a SCAN control signal line or a reference voltage supply line.

13. The pixel circuit of claim 8, further comprising a first switch transistor having a first terminal connected to the second terminal of the drive transistor and a second terminal connected to the node N1, wherein the first switch transistor is placed in an on state during the compensation phase to electrically connect the node N1 to the second terminal of the drive transistor.

14. The pixel circuit of claim 13, further comprising a second switch transistor having a first terminal connected to an initialization voltage supply line and a second terminal connected to the node N1, wherein during an initialization phase the second switch transistor is in an on state to apply an initialization voltage from the initialization voltage supply line to the node N1 to reset a voltage at the first terminal of the light-emitting device.

15. The pixel circuit of claim 14, further comprising a third switch transistor having a first terminal connected to a reference voltage supply line and having a second terminal connected to a node N2 that is a connection of the first plate of the first capacitor and the gate of the drive transistor, wherein during the initialization phase and the compensation phase the third switch transistor is in an on state to apply a reference voltage from the reference voltage supply line to the node N2.

16. The pixel circuit of claim 15, further comprising a fourth switch transistor having a first terminal connected to a data voltage supply line and a second terminal connected to the node N2, wherein during a data programming phase the fourth switch transistor is in an on state to apply a data voltage from the data voltage supply line to the node N2.

17. The pixel circuit of claim 8, further comprising a first switch transistor having a first terminal connected to a data voltage supply line and a second terminal connected to the gate of the drive transistor, wherein the first switch transistor is in an on state during both the compensation phase and during a data programming phase to apply respectively a first reference voltage and a data voltage from the data voltage supply line to the gate of the drive transistor.

18. The pixel circuit of claim 17, further comprising a second switch transistor having a first terminal connected to a reference voltage supply line and having a second terminal connected to the node N1, wherein the second switch transistor is in an on state during a reset phase to apply a second reference voltage from the reference voltage supply line to the first terminal of the light-emitting device to reset a voltage at the first terminal of the light-emitting device.

19. The pixel circuit of claim 8, further comprising a second capacitor having a first plate connected to the node N1 and a second plate connected to an input voltage supply.

20. The pixel circuit of claim 8, wherein the light-emitting device is one of an organic light-emitting diode, a micro light-emitting diode (LED), or a quantum dot LED.

* * * * *